US005397294A

United States Patent [19]

Hwang

[11] Patent Number: 5,397,294

[45] Date of Patent: Mar. 14, 1995

[54] HEALTH AID DEVICE

[76] Inventor: Chang-Shyong Hwang, 3F, No. 8, Lane 107, Chang Shun St., Taipei, Taiwan, Prov. of China

[21] Appl. No.: 140,530

[22] Filed: Oct. 25, 1993

[51] Int. Cl.[6] ..... A61H 1/00

[52] U.S. Cl. ..... 601/71; 601/70; 601/74; 601/79

[58] Field of Search ..... 600/38, 41; 601/46, 601/67, 69, 70, 71, 72, 74, 78, 79, 80

[56] References Cited

U.S. PATENT DOCUMENTS

| | | | |
|---|---|---|---|
| 1,896,351 | 2/1933 | Doran | 601/74 |
| 2,287,501 | 6/1942 | Thomas | 601/79 X |
| 2,589,322 | 3/1952 | Archer | 601/72 |
| 2,723,662 | 11/1955 | Wahl | 601/74 |
| 3,063,433 | 11/1962 | Wahl | 601/46 |
| 3,149,629 | 9/1964 | Katz | 601/46 |
| 3,291,123 | 12/1966 | Terauchi | 601/71 |
| 3,461,859 | 8/1969 | Fortnam | 601/74 |
| 3,602,217 | 8/1971 | Felton | 601/72 |
| 3,620,209 | 11/1971 | Kravitz | 601/79 |
| 3,626,931 | 12/1971 | Bysakh | 600/38 X |
| 4,488,541 | 12/1984 | Garcia | 600/38 |
| 4,697,580 | 10/1987 | Terauchi | 601/71 |
| 4,841,954 | 6/1989 | Kalsi | 601/71 |

FOREIGN PATENT DOCUMENTS

| | | | |
|---|---|---|---|
| 2207169 | 9/1972 | Germany | 600/38 |

*Primary Examiner*—Robert A. Hafer
*Assistant Examiner*—Brian E. Hanlon
*Attorney, Agent, or Firm*—Bacon & Thomas

[57] ABSTRACT

A health aid device structure which is used to place around the male penis during sexual intercourse, a high frequency vibration is generated which applies to the female private part such that her excitement period is shortened. The health aid device can also be used as a massaging device for other parts of the human body. The device has an external case, a bottom cover and a side cover, forming a box in which an eccentric cam motor and a battery pack are enclosed. Each of the two side surfaces of the external case is provided with a slot, into which the side cover is inserted and positioned in place. The side cover and the bottom cover are provided with an appropriate recessed arcuate surface, in addition, the side cover is provided with an adjustable strap and the two edges of the external case are provided with a strap having fastening members. In use, the adjustable strap is placed around the male penis, the health aid device generates a high frequency vibration so as to shorten the excitement period of the female, the orgasm stage of sexual intercourse is prolonged, and the male and female can thus obtain the same level of satisfaction during sexual intercourse.

1 Claim, 4 Drawing Sheets

HEALTH AID DEVICE

BACKGROUND OF THE INVENTION 1. (a) Field of the Invention

The present invention relates to a structure design of a health aid device, particularly to a device that is placed onto the penis of a man during the sexual intercourse. The health aid device acts as a vibrator to speed up the orgasm in woman. Physiologically, it can also function as a massaging device to the other part of the human body.

2. (b) Description of the Prior Art

Males and females are physiologically different, especially during sexual intercourse. The differences are partly caused by the physical ability of the individual. In general, the sexual excitement builds up slowly in a woman compared to a man. As shown in FIGS. 6 and 7, the curves A and B respectively represent the level of excitement of a man and a woman. The X-axis represents the length of time and the Y-axis represents the magnitude of excitement. The curves in the figures show the statistics of the majority of people. It is obvious from the Figures that the resolution stage happens in a man before a woman reaches orgasm. Therefore, there is always some problem relating to sexual intercourse. Some of these problems can lead to a dissolution of marriage.

SUMMARY OF THE INVENTION

The main object according to the present invention is to provide a health aid device structure which consists of an external case, a bottom cover and a side cover to form a box. An eccentric cam motor and a battery pack are enclosed inside the box. The side cover is provided with an adjustable strap which is placed around the male penis during sexual intercourse. The health aid device according to the present invention generates a high frequency vibration which can shorten the excitement period of the female, allowing the male and the female to reach the orgasm stage at the same time.

Another object according to the present invention is to provide a health aid device structure in which a soft plastic padding is provide in the external case or in the bottom cover. A plurality of bulges are also provided in the surface of the soft padding. Thus the health aid device can be strapped onto the hand, the leg, the neck or any other appropriate part of the human body. The high frequency vibration from the device makes it an ideal massaging tool for the human body.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
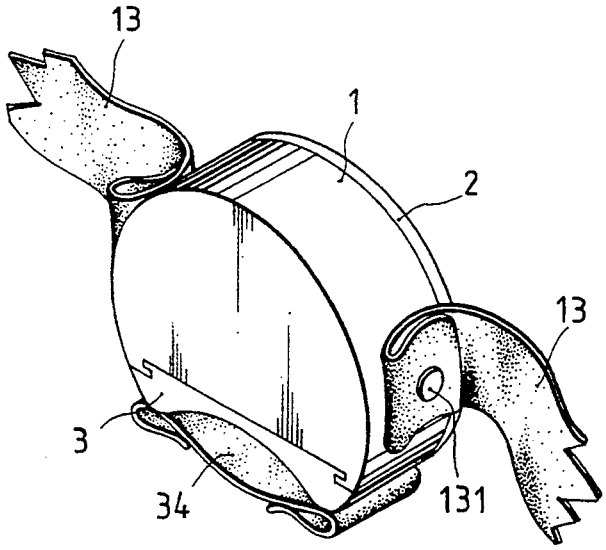
FIG. 1 is a perspective view of the health aid device assembly according to the present invention.
Figure 2:
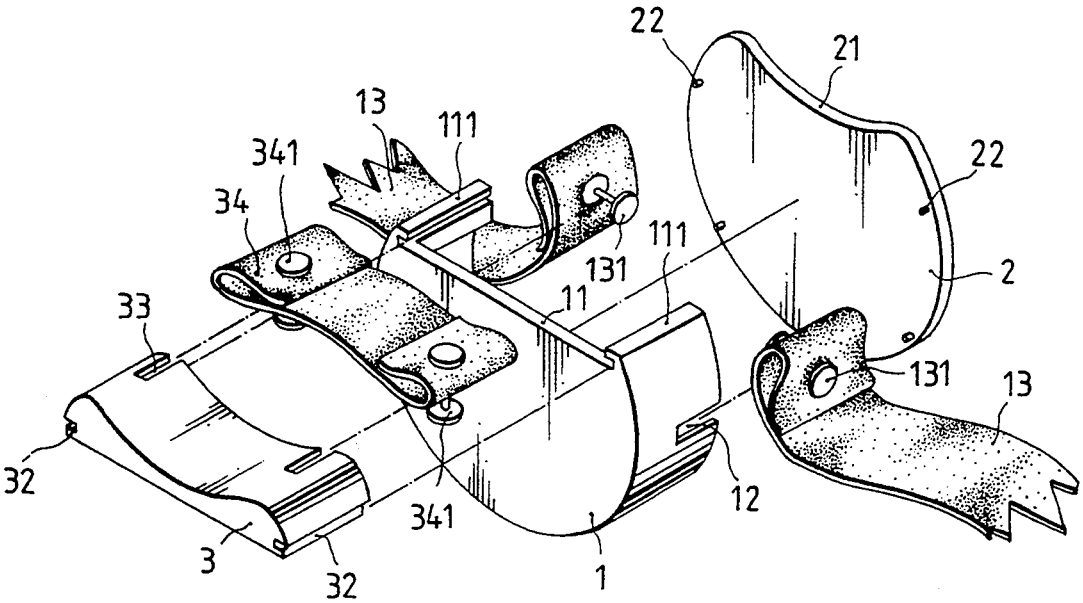
FIG. 2 is a perspective fragmented view of the health aid device according to the present invention.
Figure 3:
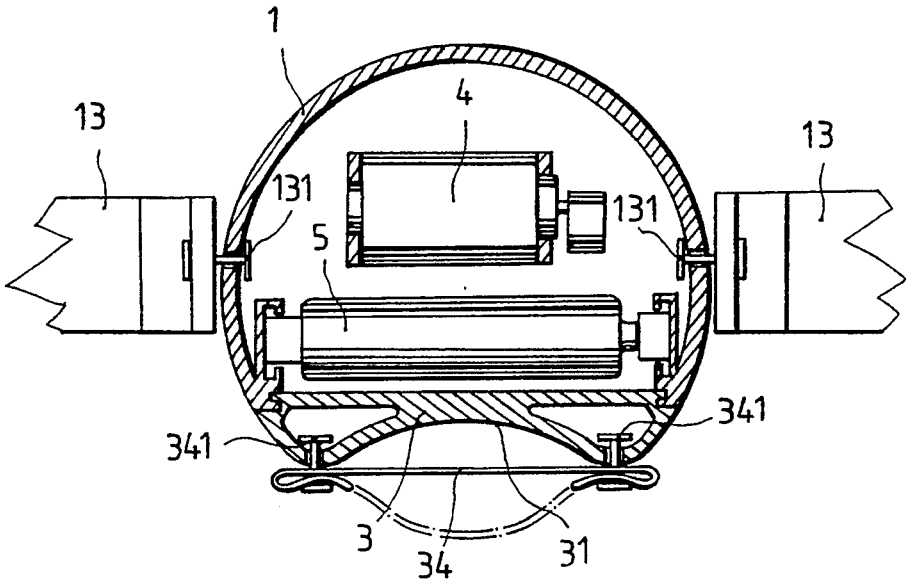
FIG. 3 is a cross-sectional view of the health aid device according to the present invention.

Referring to FIGS. 1, 2 and 3, the health aid device structure according to the present invention mainly consists of an external case 1, a bottom cover 2 and a side cover 3 to form a box. Inside the box there is provided a conventional eccentric cam motor 4 and a battery pack 5. The battery pack 5 provides power to the eccentric cam motor 4 so as to generate a high frequency vibration.

The external case 1, having an appropriate hollow body, can be of any shape. An opening 11 is formed in a side of the hollow body. The two edges of the opening 11 are provided with two male engaging portions 111. Each of the two side surfaces of the box is provided with a slot 12, to which a fastening member 131 of a body strap 13 is attached and secured.

The bottom cover 2 is an appropriate plate having a shape to match the external case 1. A portion of the edge of the bottom cover 2 has an arc-shaped recess. The bottom cover 2 is provided with a plurality of positioning columns 22 in its surface, allowing it to cooperate with the external case 1 for retaining and securing the bottom cover 2 to the external case 1.

The side cover 3 is a plate cover having a curved surface 31, the two ends of which are provided with grooves 32. The two groves 32 correspond to the two male engaging portions 111 of the opening 11 in the external case 1, for engaging each male engaging portion 111 with each groove 32 for securing the side cover 3 to the external case 1. Moreover, the two sides of the curved surface 31 are respectively provided with notches 33, to which a fastening member 341 of penis strap 34 can be retained.

Figure 4:
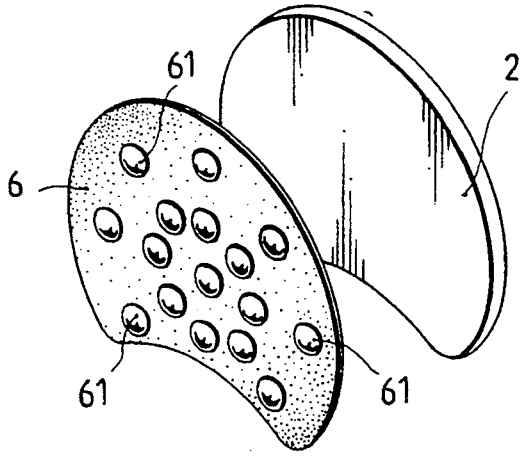
FIG. 4 is a perspective fragmented view of the bottom cover and the soft padding of the health aid device according to the present invention.

Either the surface of the external case 1 or the bottom cover 2 can also be provided with a soft padding 6, which can be made out of plastic, as is shown in FIG. 4. The surface of the soft padding 6 is provided with a plurality of bulges 61.

Figure 5:
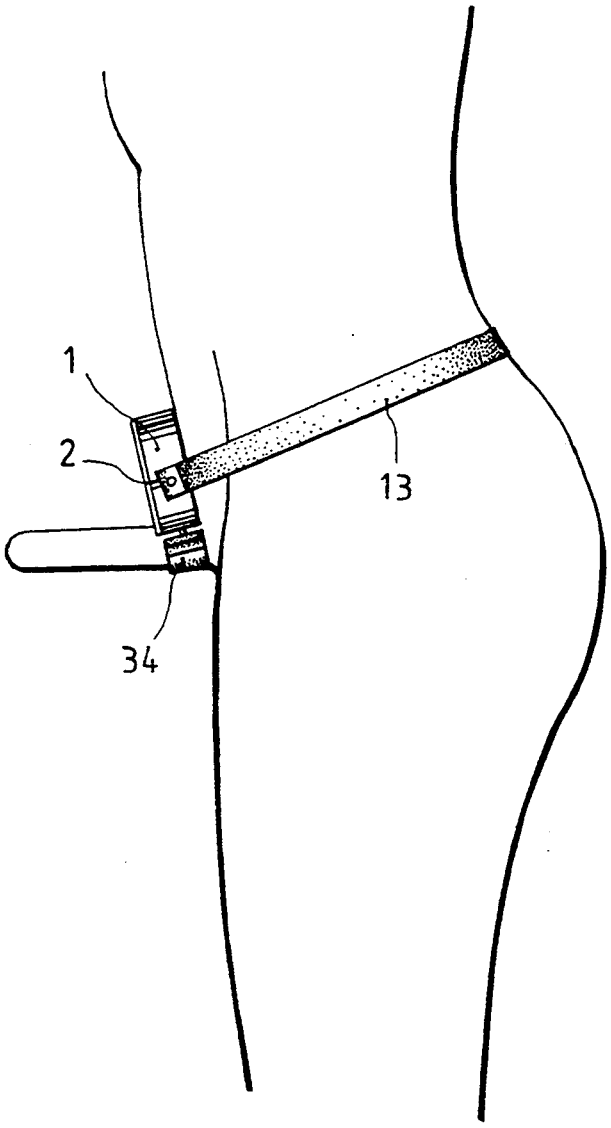
FIG. 5 is an illustrative drawing to the use of the health aid device according to the present invention.
Figure 6:
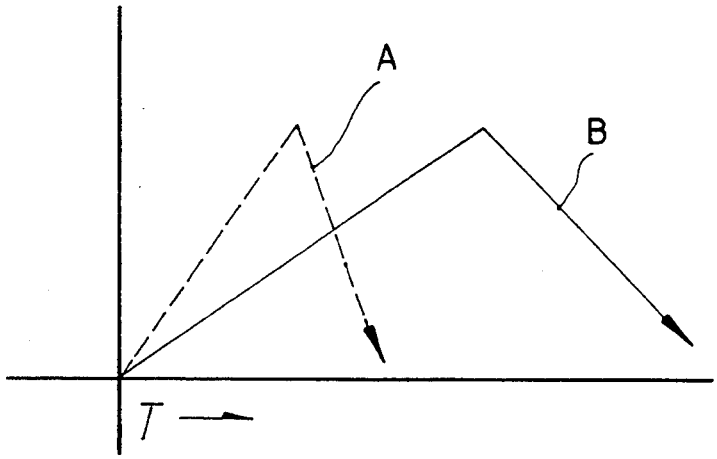
FIG. 6 is a chart showing the excitement period during sexual intercourse of the majority of males and females.
Figure 7:
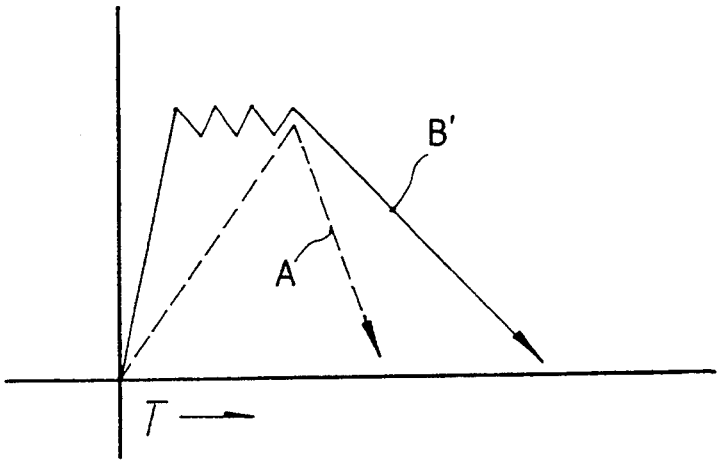
FIG. 7 is a chart showing the excitement period during sexual intercourse after the use of the health aid device according to the present invention.

By the above configuration, the health aid device according to the present invention mainly is used by a male during sexual intercourse. The penis strap 34 is placed around the penis of the male, as is shown in FIG. 5. The starting of the eccentric cam motor 4 generates a high frequency vibration from the health aid device. This vibration, as it applies to the private part of the female, can make the woman to reach the orgasm stage quicker. Thus the excitement period is shortened, as is shown in the curve B′ of FIG. 7. From this Figure, we can see that the shortening of the curve B′ is approximately identical to the curve A, which is the excitement curve from the male. Therefore, the couple can reach the orgasm stages at the same time during sexual intercourse.

Moreover, the soft padding 6 with the plurality of bulges 61 is glued onto the side surface of the bottom cover 2, which can be attached to a particular part of a body, such as the hand, the foot, the neck or any other appropriate parts, by the strap 13. The eccentric cam motor can again be used to generate a high frequency vibration, through which the bulges 61 on the soft padding 6 produce a massaging effect to give a comfortable feeling to the human body.

What is claimed is:

1. A health aid device structure comprising:

an external case having two opposite ends of said case secured to a body strap for fastening said case to a user's body;

a bottom cover; and a side cover, the external case in combination with the bottom cover and said side cover forming a box in which an eccentric cam motor powered by a battery pack is provided, and said cam motor and said battery pack are stored within said box, characterized in that:

the external case, is a hollow body having an opening formed in a side portion of the hollow body, said opening having two opposite edge portions, each said edge portion of said opening formed with a male enagaging portion;

the bottom cover is a plate having a shape to match with a shape of the external case, said bottom cover having an arc-shaped recess in a side edge portion of said bottom cover, and a plurality of positioning columns formed on a surface of said bottom cover and coupled to the external case for retaining and securing said bottom cover to said external case; and the side cover is a plate cover having a curved surface, said side cover having groves respectively recessed in two opposite edge portions of said side cover, each said groove corresponding to and engageable with each said male engaging portion in the external case for securing said side cover to the external case, and two notches respectively slotted in two opposite end portions of the curved surface of said side cover, each said notch being engaged with a fastening member of a penis strap for securing said penis strap to said side cover for fastening a user's penis between said penis strap and said curved surface of said side cover.

* * * * *